United States Patent [19]

Caveney et al.

[11] Patent Number: 4,979,414

[45] Date of Patent: Dec. 25, 1990

[54] WIRE MARKER TAPE DISPENSER

[75] Inventors: Jack E. Caveney, Hinsdale; Casimir M. Guzay, Hoffman Estates; Donald C. Wiencek, Crestwood; Othon Orellana, South Holland, all of Ill.

[73] Assignee: Panduit Corp., Tinley Park, Ill.

[21] Appl. No.: 656,632

[22] Filed: Oct. 1, 1984

[51] Int. Cl.[5] ..... B26D 1/02

[52] U.S. Cl. ..... 83/568; 83/650; 225/21; 225/34

[58] Field of Search ..... 83/568, 570, 597, 648, 83/649, 650; 225/20, 21, 34, 37, 38, 39, 57, 69, 90, 76, 78; 206/409, 411; 220/335; 242/55.53, 55.3, 71.1

[56] References Cited

U.S. PATENT DOCUMENTS

| | | | |
|---|---|---|---|
| 2,319,071 | 5/1943 | Mason | 225/43 |
| 2,473,072 | 6/1949 | Plouff | 225/34 |
| 2,506,504 | 5/1950 | Hudson | 242/55.5 |
| 2,776,095 | 1/1957 | Emmert | 242/55.5 |
| 3,102,671 | 9/1963 | Gershen | 235/43 |
| 3,311,278 | 3/1967 | Brandon | 83/649 |
| 3,502,252 | 3/1970 | Mariani | 225/33 |
| 3,521,800 | 7/1970 | Stephens et al. | 225/21 |
| 3,547,327 | 12/1970 | Mariani | 225/38 |
| 4,124,151 | 11/1978 | Hazard | 220/335 |
| 4,252,258 | 2/1981 | Plummer, III | 225/25 |
| 4,262,835 | 4/1981 | Wrobel | 225/25 |
| 4,493,446 | 1/1985 | Wirth | 225/21 |

*Primary Examiner*—Hien H. Phan

*Attorney, Agent, or Firm*—Charles R. Wentzel; Mark D. Hilliard

[57] ABSTRACT

A tape dispenser includes a housing having at least one compartment that rotatably mounts a roll of adhesive tape. Integrally molded adjacent to each compartment is a hinged door movable between an open position, a closed postion and a tape severance position. The door is maintained in the closed position by the latching interaction of the edges of the door and a pair of wedge-shaped ramps disposed on opposing lateral walls of the compartment. An upwardly angled resilient tab is integrally molded with the housing and disposed within each compartment between a severance means and the rotatably mounted tape roll. The tab upwardly directs the distal end of the tape out of the compartment and presents the distal end of the tape to the user to facilitate withdrawal of the tape from the dispenser.

24 Claims, 4 Drawing Sheets

WIRE MARKER TAPE DISPENSER

TECHNICAL FIELD

The present invention relates generally to a device for dispensing tape and more particularly to a device for dispensing multiple rolls of wire marker tape.

BACKGROUND ART

Wire marker tape is utilized to identify individual lengths of wire and is typically provided as multiple rolls of pressure sensitive adhesive tape; each roll of tape being repetitively marked with a different alphanumeric character. Typically, the wire marker tape is applied by an electrician in a factory environment, thus dictating the need for an easily manipulated, light weight and portable multiple roll tape dispenser.

Additional characteristics desirable in a portable wire marker tape dispenser include the ability of the dispenser to present the distal end of the roll of tape to the user for easy withdrawal, the ability of the dispenser to easily and precisely sever an increment of tape from the roll, and the absence of sharp edges when the dispenser is closed.

The prior art tape dispeners have not solved the problem of providing a multiple roll tape dispenser that possesses all of the characteristics desirable in a multiple roll wire marker tape dispenser. Examples of multiple roll tape dispensers include U.S. Pat. Nos. 3,502,252; 3,547,327; 4,252,258; and 4,262,835.

DISCLOSURE OF THE INVENTION

Among the several objects of the present invention may be noted, the provision of an improved device to dispense wire marker tape; the provision of such a device that is portable and easily manipulated; the provision of such a device that presents the distal end of the tape to the user for easy removal; the provision of such a device that allows precise severance of the adhesive tape; the provision of such a device that in its closed position does not present any sharp knife edges; and the provision of such a device that is simple and inexpensive to manufacture, the entire device only requiring the manufacture of two separate components, one of which can be integrally molded to form all of the moving structural features of the tape dispenser.

In general, a device for dispensing adhesive tape includes a housing having at least one compartment that rotatably mounts a roll of adhesive tape; the compartment having an integrally molded hinged door disposed adjacent thereto. The hinged door is movable between an open position, which allows access to the distal end of the tape and allows a fresh roll of tape to be loaded; a closed position, which prevents access to the compartment and prevents contact with a tape severance blade; and a tape severance position, which effects severance of the distal end of the tape from the tape roll. The door is maintained in the closed position by the latching interaction of the edges of the door and a pair of wedge-shaped ramps disposed on opposing inner lateral walls of the compartment. The ramps are disposed to latch the door in the closed position while allowing movement between the closed position and the tape severance position. The severance means includes a metal blade transversely disposed relative to the path of the distal end of the tape roll. The blade is mounted on the housing to cooperate with an anvil surface on the underside of the door to precisely sever discrete sections of tape from the roll. A resilient tab is disposed in the path of tape and between the tape roll and the severance means. The tab is upwardly angled to upwardly direct the distal end of the tape out of the compartment and present the distal end of the tape to the user to facilitate withdrawal of the tape from the dispenser. The tab is integrally molded with the housing. The tab is disposed to be non-compressed when the door is in the closed position thus preventing creep induced permanent deformation of the thin plastic tab that could result if the plastic tab was held in compression. Movement of the door from the closed position to the tape severance position compresses the resilient tab and retrograde movement relaxes the tab.

PREFERRED EMBODIMENT FOR CARRYING OUT THE INVENTION

A multiple roll adhesive tape dispenser embodying the concept of the present invention is designated generally by the numeral 20 in the accompanying drawings. The tape dispenser 20 includes a series of ten similar sections, each section dispensing a single roll of wire marking adhesive tape. Tape dispenser 20 is preferably manufactured with two interlocking components, namely: a one-piece thermoplastic housing 22, best seen in FIG. 1, and a one-piece metal blade 24, best seen in FIG. 12. The two part design of tape dispenser 20 effects a tape dispenser that is economical and reliable.

Figure 9:
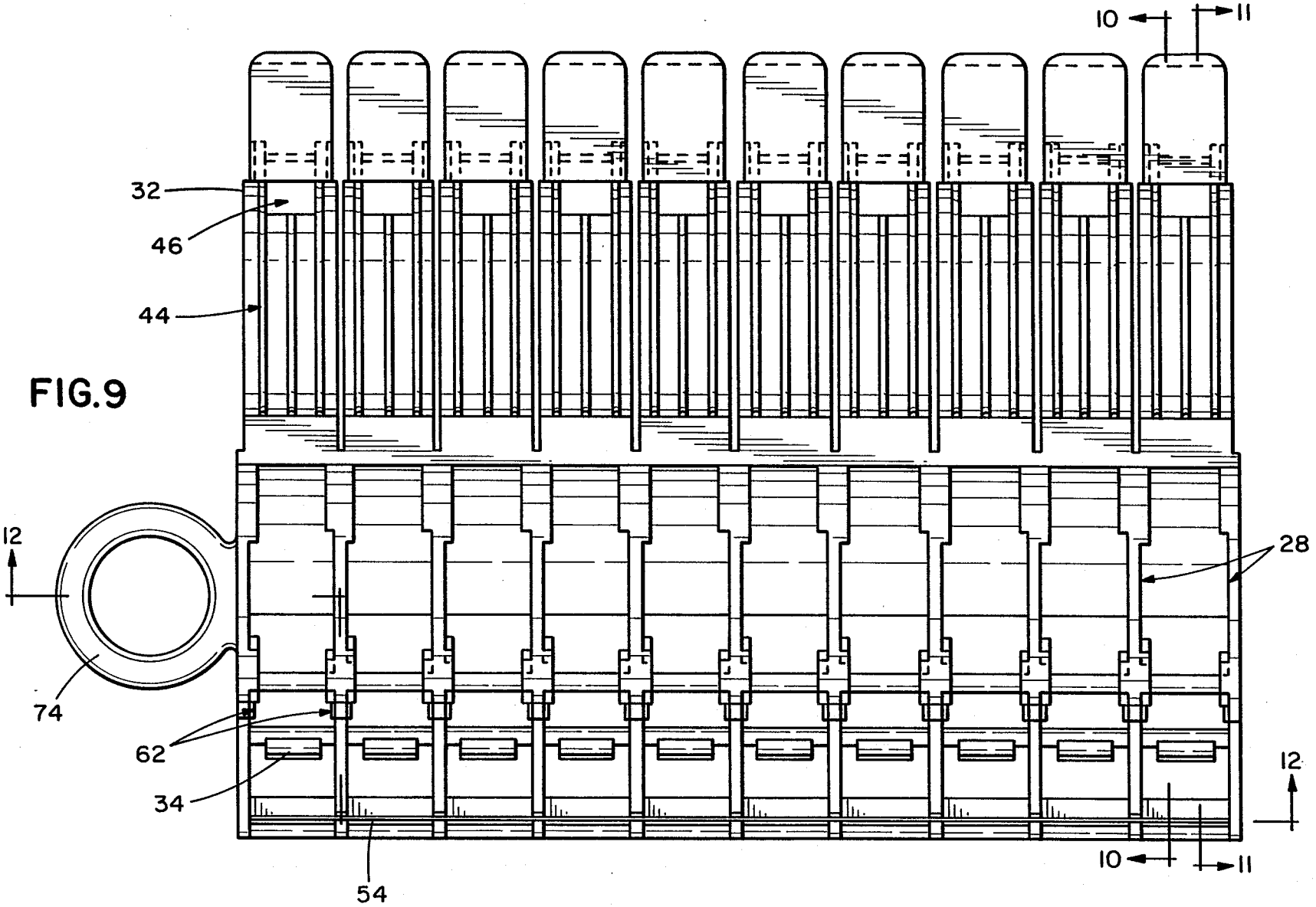
FIG. 9 is a top view of the tape dispenser of FIG. 1 with all doors open.

Tape dispenser 20 has a generally cylindrical molded thermoplastic housing 22 that presents a longitudinal flange 26. Parallel walls 28 are arranged transverse to the longitudinal axis of dispenser 20; walls 28 defining tape mounting compartments 30. Housing 22 includes a plurality of integrally molded doors 32, and a plurality of integrally molded resilient spring tabs 34, best seen in FIGS. 9, 10, and 11. Formed on the surface of housing 22 opposite doors 32 are a plurality of access windows 36, each communicating with its respective compartment 30.

Door 32 includes an arcuate section 38 and an arm section 40. Arcuate section 38 is attached to housing 22 by a thin plastic hinge 42. Formed on the inner surface of arcuate section 38 are reinforcing ribs 44. A door window 46 is formed in the forward portion of arcuate section 38 of door 32 to allow visual identification of the marker tape mounted within compartment 30. Arm section 40 is generally planar and is joined to arcuate section 38 by a triangular reinforcing gusset 48. The distal end of arm section 40 is provided with a ridge 50 to facilitate manipulation of door 32. An inner anvil surface 52 of arm section 40 is planar and projects over a knife edge 54 of blade 24 when door 32 is closed.

Figure 3:
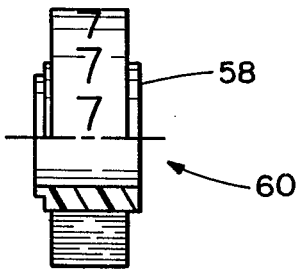
FIG. 3 is a front view of a roll of wire marker adhesive tape, half in section, mounted on a tape hub compatable with the tape dispenser of FIG. 1.
Figures 10, 11, 12:
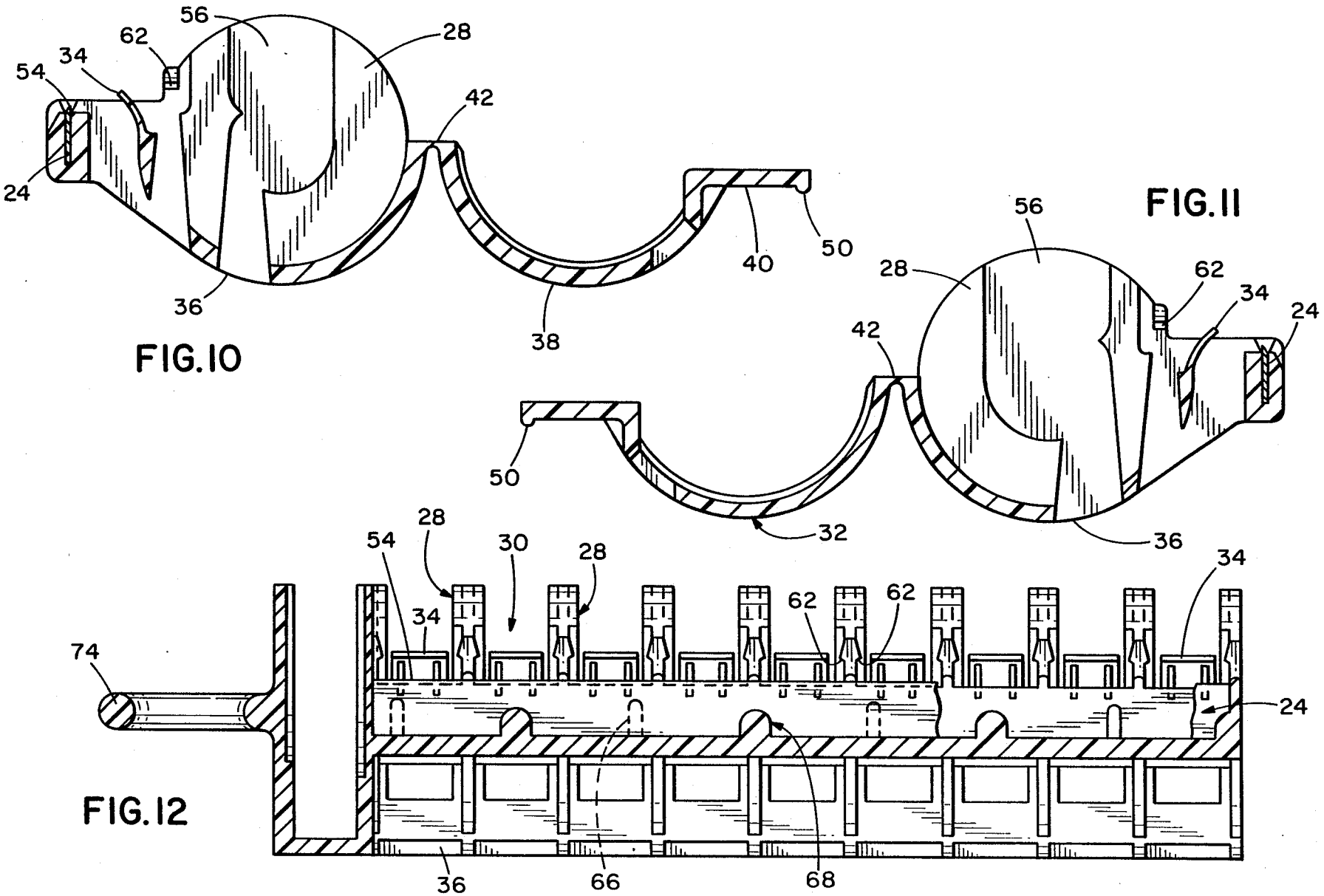
FIG. 10 is a sectional view of the tape dispenser of FIG. 1 taken along line 10—10 of FIG. 9.
FIG. 11 is a sectional view of the tape dispenser of FIG. 1 taken along line 11—11 of FIG. 9.
FIG. 12 is a sectional view of the tape dispenser of FIG. 1 as taken along line 12—12 of FIG. 9.

As seen in FIGS. 10 and 11, opposing walls 28 have mounting tracks 56 that accept and rotatably mount a hub 58 of a tape roll 60 as seen in FIG. 3. The tracks 56 have differing diameters to only accept respectively sized diameters of hub 58 and ensure correct orientation of tape roll 60.

Figure 1:
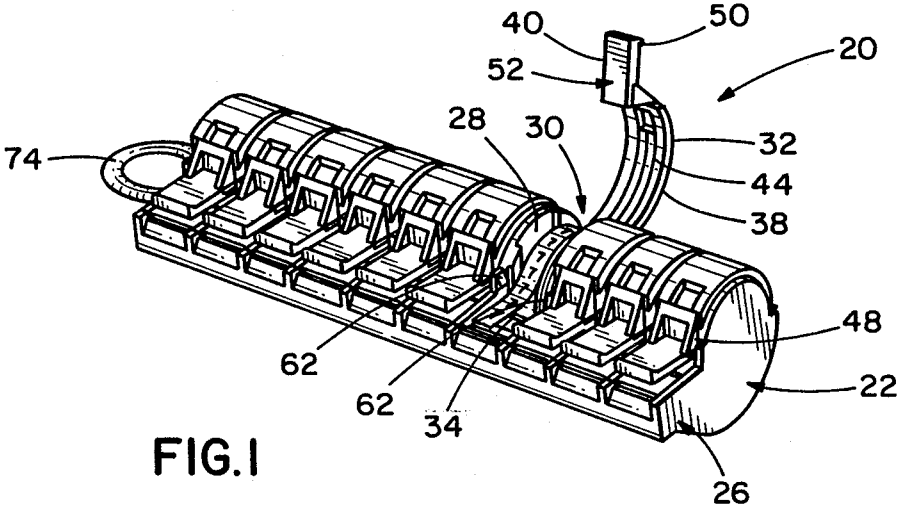
FIG. 1 is a perspective view of a tape dispenser embodying the concept of the present invention, the dispenser having one door open exposing the rotatably mounted roll of adhesive tape within.
Figure 2:
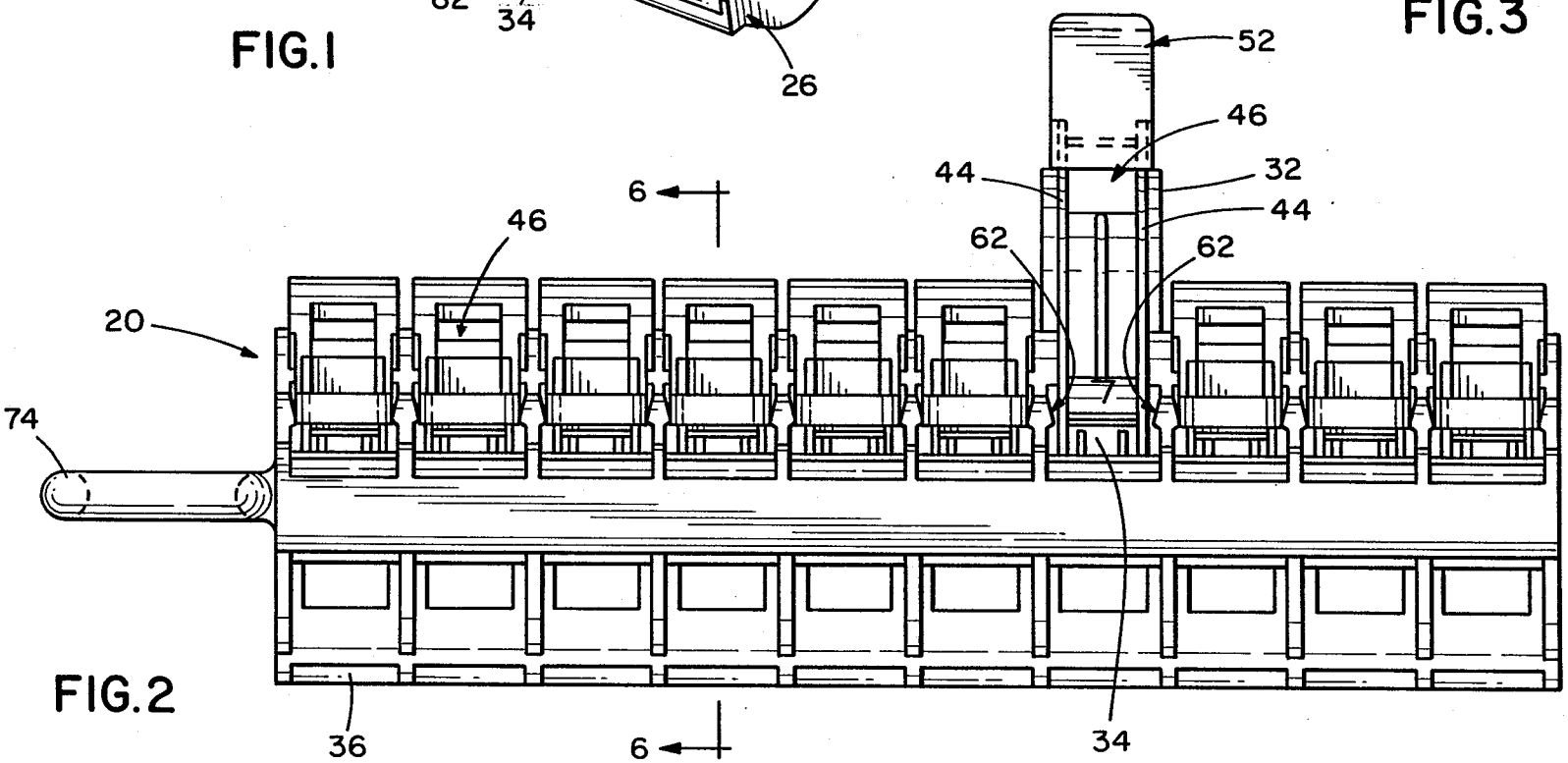
FIG. 2 is a front view of the tape dispenser of FIG. 1.
Figure 4:
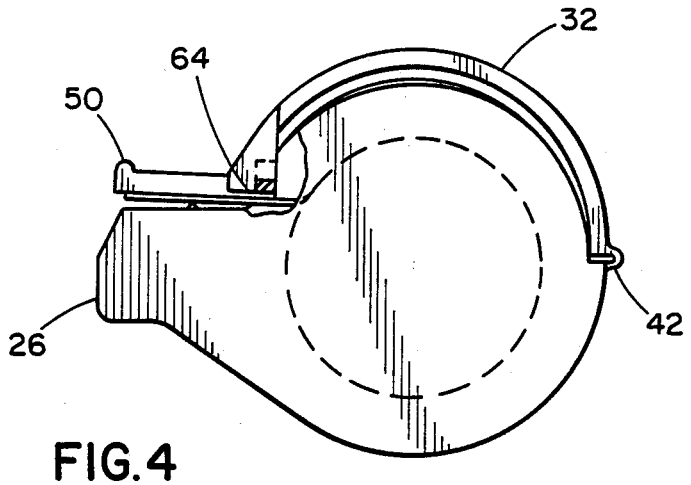
FIG. 4 is an end view of the tape dispenser of FIG. 1.
Figure 5:
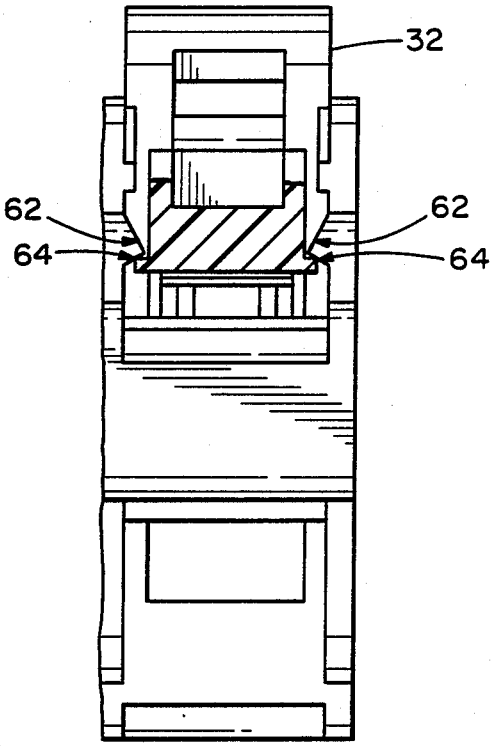
FIG. 5 is a partial front view of the tape dispenser of FIG. 1, FIG. 5 showing the tenth tape compartment of the tape dispenser as seen with its door closed and with the arm portion of the door removed.

A pair of wedge shaped ramps 62, as seen in FIGS. 1, 2 and 5, are formed on and protrude from opposing inner lateral walls 28. The ramps 62 are disposed to latch door 32 by interferingly cooperating with respective projecting edges 64 on door 32.

As best seen in FIG. 12, blade 24 is constructed as a one-piece planar metal blade having a plurality of individual knife edges 54 disposed to project upwardly toward each anvil surface 52 of each closed door 32. Blade 24 is securely mounted to housing 22 by locking interaction between housing 22 and a plurality of indentations 66 and recesses 68 in blade 24.

Figure 6:
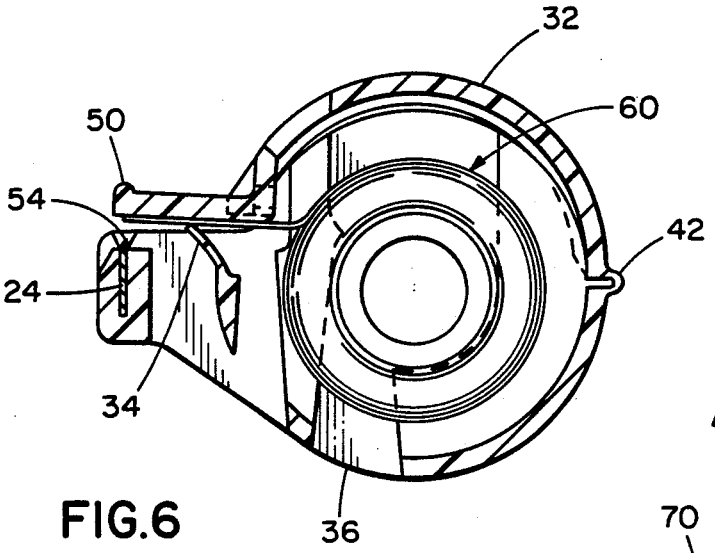
FIG. 6 is a sectional view of the tape dispenser of FIG. 1 taken along line 6—6 of FIG. 2 showing the dispenser door in its closed position.
Figure 7:
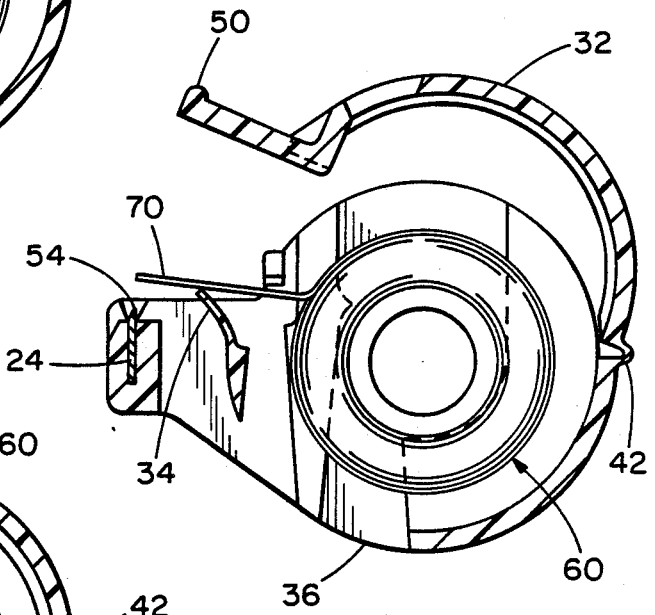
FIG. 7 is a sectional view similar to FIG. 6 showing the dispenser door in its open position.
Figure 8:
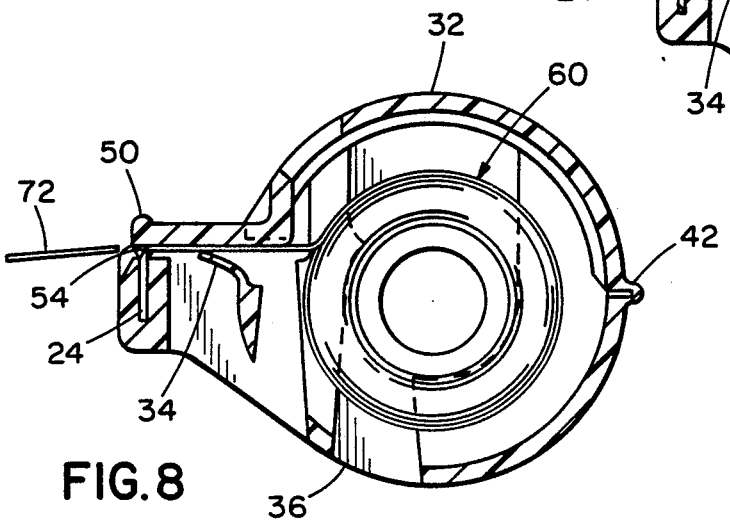
FIG. 8 is a sectional view similar to FIG. 6 showing the dispenser door in its tape severance position.

The operational positions of door 32 and resilient tab 34 are depicted in FIGS. 6, 7 and 8. FIG. 7 shows door 32 in its open position. In the open position, door 32 allows access to a distal portion 70 of tape roll 60. Distal portion 70 is directed upwardly by resilient tab 34; the distal end of tab 34 being spaced inwardly from knife edge 54, allowing overlapping tape portion 70 to project outwardly from tab 34 and present the end of tape roll 60 to the user.

In the closed position depicted in FIG. 6, door 32 prevents access to compartment 30 and arm section 40 covers knife edge 54, preventing undesired contact with knife edge 54. Door 32 is held in the closed position by the latching interaction of projecting edges 64 on arm section 40 and wedge shaped ramps 62 disposed on opposing inner lateral surfaces of walls 28. The ramps 62 latch door 32 in the closed position while allowing movement of door 32 between the closed position and the tape severance position.

The tape severance position is depicted in FIG. 8. In the severance position, tab 34 is resiliently compressed and anvil surface 52 contacts knife edge 54, severing a discrete section of tape 72 from tape roll 60. Door 32 is upwardly biased away from the severance position by the configuration of hinge 42 which biases door 32 toward the open position. The compressed resilient tab 34 also biases door 32 upwardly towards the closed position. Thus the removal of downward manual force from door 32 allows door 32 to return to the closed position.

To use tape dispenser 20, a roll of adhesive tape is properly oriented and inserted into mounting tracks 56 where it is rotatably mounted. With door 32 in the open position, the distal end of tape roll 60 is drawn over tab 34 and past knife edge 54 until a desired length of tape is positioned past knife edge 54. The construction of tape dispenser 20 allows very accurate placement of the alphanumeric characters on the surface of the tape relative to knife edge 54; thus allowing the user to sever pieces of tape having single characters from tape roll 60. After the tape is properly positioned, door 32 is moved from the open position and past the closed position to the tape severance position, severing the tape.

In absence of the application of downward force to door 32, door 32 is returned to the closed position by the combination of the natural bias of hinge 42 and the natural biasing force applied to door 32 by resilient tab 34. Door 32 is held in the closed position by the latching interaction of ramps 62 with door 32 until the application of an upward force sufficient to overcome the latching force of ramps 32, opening door 32. When door 32 is in the closed position, plastic resilient tab 34 is disposed in a non-compressed position thus preventing premanent deformation of tab 34 due to creep of the plastic tab 34. In the closed position, access to knife edge 54 is prevented by overlaying door 32. When door 32 is open, tab 34 directs distal portion 70 upwardly and out of compartment 30 presenting distal portion 70 to the user to facilitate withdrawal of tape from dispenser 20. To replace an exhausted tape roll 60, an elongated object such as a pencil is inserted through access window 36 and tape hub 58 is forced from an open compartment 30.

To facilitate the portability of dispenser 20, a handle 74 can be integrally molded on housing 22. Handle 74 allows dispenser 20 to be securely attached to a users tool belt preventing loss of dispenser 20.

We claim:

1. A tape dispenser for dispensing a roll of adhesive tape, comprising:
   - a housing having at least one compartment for rotatably mounting a roll of tape;
   - a hingedly mounted door integral with said housing and movable between an open position, a closed position and a tape severance position;
   - a severance means for separating discrete sections of tape from the roll; and
   - spring means for presenting the distal end of the tape outward of said compartment facilitating removal of the tape, said spring means being integrally formed with said housing and positioned within said compartment.

2. A tape dispenser as set forth in claim 1, wherein:
   - said severance means includes a knife edge disposed transverse to the path of the tape, said knife edge cooperating with an anvil surface to sever said tape when said tape is positioned over said knife edge and said door is disposed in said tape severance position.

3. A tape dispenser as set forth in claim 2 further comprising means to latch said door in said closed position while allowing movement of said door between said closed position and said tape severance position.

4. A tape dispenser as set forth in claim 3, wherein said latch means includes a protuberance disposed on the inner lateral wall of said compartment, said protuberance being disposed to cooperate with an edge on said door to selectively latch said door in said closed position.

5. A tape dispenser as set forth in claim 4, wherein:
   - said door has an arcuate portion and an arm portion, said arcuate portion being joined at a first end to said housing by an integral hinge and said arcuate portion merging with said arm portion at a medial area, said arm portion projecting from said medial area to its distal end; and said edge of said door is disposed on the outward lateral edge of said arm portion adjacent said medial area.

6. A tape dispenser as set forth in claim 5, wherein said door is sufficiently biased towards said open position to return said door from said severance position to said closed position and bias said edge of said door against said protuberance.

7. A tape dispenser as set forth in claim 6, wherein spring means is disposed to contact said door when it is in said severance position and bias said door towards said closed position.

8. A tape dispenser as set forth in claim 1, wherein:

said spring means comprises a resilient tab disposed between said severance means and the tape roll, said tab being upwardly angled in its non-compressed position to upwardly direct the distal end of the tape out of said compartment.

9. A tape dispenser as set forth in claim 8, wherein:

said resilient tab is disposed to bias said door from said tape severance position towards said closed position; and said resilient tab is disposed to be non-compressed when said door is in the closed position, movement of said door from said closed position to said tape severance position compressing said resilient tab and movement of said door from said tape severance position to said closed position relaxing said resilient tab.

10. A tape dispenser as set forth in claim 9, wherein said severance means includes a knife edge disposed transverse to the path of the tape, said knife edge cooperating with an anvil surface to sever said tape when said tape is positioned over said knife edge and said door is disposed in said tape severance position.

11. A tape dispenser as set forth in claim 10, further comprising means to latch said door in said closed position while allowing movement of said door between said closed position and said tape severance position.

12. A tape dispenser as set forth in claim 11, wherein a distal end of said reslient tab is spaced inwardly from said knife edge, allowing the overlapping tape to project outwardly from said resilient tab and present a distal grasping surface.

13. A tape dispenser as set forth in claim 12, wherein said latch means includes a protuberance disposed on the inner lateral wall of said compartment, said protuberance being disposed to cooperate with an edge on said door to selectively latch said door in said closed position.

14. A tape dispenser as set forth in claim 13, wherein:

said door has an arcuate portion and an arm portion, said arcuate portion being joined at a first end to said housing by an integral hinge and said arcuate portion merging with said arm portion at a medial area, said arm portion projecting from said medial area to its distal end; and said edge of said door is disposed on the outward lateral edge of said arm portion adjacent said medial area.

15. A tape dispenser as set forth in claim 14, wherein said door is sufficiently biased towards said open position to return said door from said severance position to said closed position and bias said edge of said door against said protuberance.

16. A tape dispenser as set forth in claim 15, wherein said resilient tab is disposed to contact said door when it is in said severance position and bias said door towards said closed position.

17. A tape dispenser for dispensing multiple rolls of adhesive tape, comprising:

a housing having a plurality of compartments, each compartment rotatably mounting a roll of adhesive tape;

a plurality of doors integrally formed with said housing and disposed adjacent respective compartments; said doors being independently movable between an open position which allows access to and withdrawal of the end of the roll of tape, a closed position which prevents access to said compartment and a severance position which effects severance of a piece of tape from the tape roll;

severance means independently operable for each roll of tape for separating discrete sections of tape from each tape roll; and spring means disposed in each compartment for presenting the distal end of the tape outward of said compartment facilitating withdrawal of the tape from said dispenser, said spring means being integrally formed with said housing.

18. A tape dispenser as set forth in claim 17, wherein said spring means includes a resilient tab positioned in each compartment between said severance means and the tape roll, said tab being upwardly angled in its non-compressed position to upwardly direct the distal end of the tape out of said compartment.

19. A tape dispenser as set forth in claim 18, wherein said resilient tab is disposed to be non-compressed when said door is in said closed position, movement of said door from said closed position to said tape severance position compressing said resilient tab and movement of said door from said tape severance position to said closed position relaxing said resilient tab.

20. A tape dispenser as set forth in claim 19 further comprising means to independently latch each of said doors in said closed position while allowing movement of each of said doors between said closed position and said tape severance position.

21. A tape dispenser as set forth in claim 20, wherein each of said resilient tabs is disposed to contact its respective door when it is in said severance position and bias said door towards said closed position.

22. A tape dispenser as set forth in claim 21, wherein said latch means includes a protuberance disposed on an inner lateral wall of each of said compartments, said protuberance being disposed to cooperate with an edge of each respective door to selectively latch said door in said closed position.

23. A tape dispenser as set forth in claim 22, wherein:

said doors each have an arcuate portion and an arm portion, said arcuate portion being joined at a first end to said housing by an integral hinge and said arcuate portion merging with said arm portion at a medial area, said arm projecting from said medial area to its distal end; and said severance means includes a blade disposed to present a knife edge transverse to the path of each roll of tape, said knife edge cooperating with an anvil surface to sever said tape when said tape is positioned adjacent said knife edge and said door is disposed in said tape severance position.

24. A tape dispenser as set forth in claim 23, wherein the distal end of said resilient tab is spaced inwardly from said knife edge, allowing the overlapping tape to project outward from said resilient tab and present a distal grasping surface.

* * * * *